US007219612B1

(12) United States Patent
Zank

(10) Patent No.: US 7,219,612 B1
(45) Date of Patent: May 22, 2007

(54) NAVAL SHIP DECOY

(75) Inventor: Paul A. Zank, Brookline, NH (US)

(73) Assignee: BAE Systems Information And Electronic Systems Integration Inc., Nashua, NH (US)

( * ) Notice: Subject to any disclaimer, the term of this patent is extended or adjusted under 35 U.S.C. 154(b) by 187 days.

(21) Appl. No.: 11/155,046

(22) Filed: Jun. 17, 2005

Related U.S. Application Data

(60) Provisional application No. 60/580,456, filed on Jun. 17, 2004.

(51) Int. Cl.
*B63G 9/00* (2006.01)
*H04K 3/00* (2006.01)

(52) U.S. Cl. ..... 114/15; 367/1

(58) Field of Classification Search ..... 114/14, 114/15
See application file for complete search history.

(56) References Cited

U.S. PATENT DOCUMENTS

| | | | | |
|---|---|---|---|---|
| 3,956,729 | A * | 5/1976 | Epstein et al. | 367/1 |
| 5,144,587 | A * | 9/1992 | Mason | 367/1 |
| 5,895,882 | A * | 4/1999 | Woodall, Jr. | 102/341 |
| 2004/0228213 | A1 * | 11/2004 | Dutton et al. | 367/1 |

* cited by examiner

*Primary Examiner*—Jesús D. Sotelo
(74) *Attorney, Agent, or Firm*—Daniel J. Long

(57) ABSTRACT

A method for defeating or reducing the effectiveness of efforts to detect, track or target a naval vessel by means of its characteristic underwater and electrical fields. In this method, a wave form which mimics the characteristic electrical field produced by a particular type of naval vessel is first ascertained. A decoy which is able to produce, amplify and transmit this wave form which mimics the characteristic electrical field produced by said particular type of naval vessel is then deployed.

25 Claims, 1 Drawing Sheet

NAVAL SHIP DECOY

CROSS REFERENCE TO RELATED APPLICATION

This application claims rights under 35 U.S.C.§119(e) from U.S. Application Ser. No. 60/580,456, filed Jun. 17, 2004.

BACKGROUND OF THE INVENTION

1. Field of the Invention

The present invention relates to decoys and more particularly to decoys for use in naval warfare.

2. Brief Description of Prior Developments

For many years, submarines and other submersible vessels have enjoyed the advantage of being relatively difficult to detect. In recent years, the navies of the world have begun to explore the possibility of detecting, tracking and targeting submarines and other submersibles as well as other vessels by detecting and measuring underwater electrical fields which may be produced by such vessels.

A need, therefore, exists for a means to reduce or delay the ability to detect, track, and target vessels by detecting and measuring characteristic underwater electrical fields produced by such vessels.

SUMMARY OF INVENTION

The present invention is a method for defeating or reducing the effectiveness of efforts to detect, track or target naval vessels by detecting and measuring characteristic underwater electrical fields produced by such vessels. This method includes the steps of ascertaining a wave form which mimics the electrical field produced by a particular type of naval vessel. A decoy is then caused to produce, amplify and transmit a wave form which mimics the electrical field by the particular type of naval vessel sought to be simulated. The decoy, therefore, will tend to be misidentified as the particular type of vessel sought to be simulated.

This invention also encompasses a decoy for defeating or reducing the effectiveness of efforts to detect, track or target a particular type of naval vessel by detecting or measuring the characteristic underwater electrical field produced by such a vessel. This apparatus includes a wave form generator for producing a wave form which mimics the characteristic underwater electrical field produced by said particular type of naval vessel sought to be simulated. This apparatus also includes means for amplifying and transmitting this waveform mimicking the characteristic in the electric field produced by the particular type of naval vessel sought to be simulated. The decoy will thus tend to be misidentified as said particular type of naval vessel.

BRIEF DESCRIPTION OF THE DRAWINGS

The present invention is further described with reference to the accompanying drawings wherein.

DETAILED DESCRIPTION OF THE PREFERRED EMBODIMENT

Figure 1:
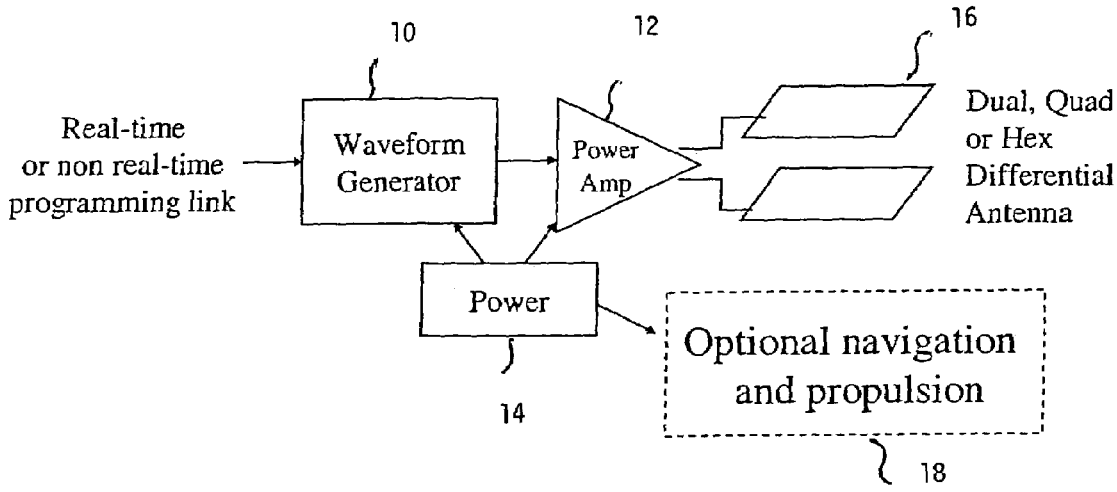
FIG. 1 is a schematic block diagram showing a preferred embodiment of the decoy of the present invention.

Referring to FIG. 1, a real-time or non real-time programming link to enable the commencing of an electrical field produced by a particular type of naval vessel is provided to a wave form generator 10. This wave form generator 10 transmits a suitable wave form to power amplifier 12. Power source 14 supplies power to both the wave form generator 10 and the power amplifier 12. A signal which mimics the characteristic electrical field of the particular type of vessel sought to be mimicked is transmitted from a dual, quad or hex differential antenna 16. It may be desirable to provide the decoy with the capability to be mobile, in which case an optional navigation and propulsion unit 18 which is powered by power source 14 may also be provided.

Those skilled in the art will appreciate that as a ship's propeller rotates it creates an alternating electrical field. It is believed that this alternating electric field establishes a spectrally pure signature which varies very little with respect to time. A relatively large signal to noise ratio may, therefore, be used. Furthermore changing flux lines actually rotate with the propeller so that 2, 4, or 6 antennas, for example, may be used.

Those skilled in the art will also understand that the decoy described herein may be used to mimic the characteristic electrical fields which maybe produced by particular types of naval vessels. Such decoys may be produced at a relatively low cost. While there may be practical limits to the numbers of such decoys which might be deployed by a single surface vessel or aircraft, these decoys could be deployed in substantial numbers.

It will therefore be appreciate that the decoy and method described herein provides a reliable and cost effective way of reducing the effectiveness or defeating efforts to detect, track and target friendly naval vessels by means of electrical fields.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method for defeating or reducing the effectiveness of efforts to detect, track or target a particular type of naval vessel by means of its characteristic underwater electrical field, said method comprising the steps of:

ascertaining a wave form which mimics the characteristic electrical field produced by said particular type of naval vessel; and causing a decoy to produce, amplify and transmit said wave form which mimics the characteristic electrical field produced by said particular type of naval vessel, whereby said decoy will tend to be misidentified as said particular type of naval vessel.

2. The method of claim 1 wherein a wave form generator produces the wave form.

3. The method of claim 2 wherein the wave form generator transmits the wave form to a power amplifier which amplifies said wave form.

4. The method of claim 3 wherein there is a power source which provides power to the wave form generator.

5. The method of claim 4 wherein the power source also provides power to the power amplifier.

6. The method of claim 2 wherein there is an antenna connected to the wave form generator which transmits the wave form.

7. The method of claim 6 wherein the antenna is a differential antenna.

8. The method of claim 2 wherein the wave form generator is included in a decoy and said decoy is caused to move.

9. The method of claim 8 wherein the decoy is self propelled.

10. The method of claim 8 wherein the decoy is navigated.

11. The method of claim 10 wherein the decoy is self navigated.

12. The method of claim 1 wherein the characteristic electrical field of the naval vessel is an alternating electrical field created by a propeller of the naval vessel.

13. The method of claim 12 wherein the alternating electric field establishes a substantially spectrally pure signature which does not vary substantially with time.

14. The method of claim 13 wherein a relatively large signal to noise ratio is used.

15. The method of claim 12 wherein there are changing flux lines which rotate with the propeller.

16. A decoy for defeating or reducing the effectiveness of efforts to detect track or target a particular type of naval vessel by means of its characteristic underwater electrical field comprising:

a wave form generator for producing a waveform which mimics the characteristic underwater electric field produced by said particular type of naval vessel; and means for amplifying and transmitting said wave form mimicking the characteristic electrical field produced by said particular type of naval vessel, whereby said decoy will tend to be misidentified as said particular type of naval vessel.

17. The decoy of claim 16 wherein a wave form generator produces the wave form.

18. The decoy of claim 17 wherein the wave form generator transmits the wave form to a power amplifier which amplifies said wave form.

19. The decoy of claim 18 wherein there is a power source which provides power to the wave form generator.

20. The decoy of claim 19 wherein the power source also provides power to the power amplifier.

21. The decoy of claim 16 wherein there is an antenna connected to the wave form generator which transmits the waveform.

22. The decoy of claim 21 wherein the antenna is a differential antenna.

23. The decoy of claim 16 wherein the decoy is moved by a propulsion means.

24. The decoy of claim 23 wherein the decoy is self propelled.

25. The decoy of claim 24 wherein the decoy includes a navigation means.

* * * * *